United States Patent [19]

Nicolas et al.

[11] 4,090,939

[45] May 23, 1978

[54] ELECTROLYTIC DIAPHRAGM CELL

[75] Inventors: Edgard Nicolas; Louis Bourgeois, both of Brussels, Belgium

[73] Assignee: Solvay & Cie, Belgium

[21] Appl. No.: 647,751

[22] Filed: Jan. 9, 1976

[30] Foreign Application Priority Data

Jan. 20, 1975 France ..... 75 01873

[51] Int. Cl.[2] ..... C25B 1/16; C25B 1/26; C25B 11/06

[52] U.S. Cl. ..... 204/258; 204/263; 204/266; 204/280; 204/290 R

[58] Field of Search ..... 204/290 R, 290 F, 252, 204/286, 282, 258

[56] References Cited

U.S. PATENT DOCUMENTS

| | | | |
|---|---|---|---|
| 2,682,505 | 6/1954 | Greco | 204/284 |
| 3,222,270 | 12/1965 | Edwards | 204/290 F X |
| 3,235,473 | 2/1966 | LeDuc | 204/30 |
| 3,778,307 | 12/1973 | Beer et al. | 204/290 F X |

*Primary Examiner*—Arthur C. Prescott
*Attorney, Agent, or Firm*—Robert E. Burns; Emmanuel J. Lobato; Bruce L. Adams

[57] ABSTRACT

A diaphragm cell for use in the electrolysis of an aqueous solution of alkali metal chloride. The cell is provided with a chamber divided by a diaphragm into an anode compartment having at least one anode therein and a cathode compartment having at least one cathode therein. The cathode has a catalytic surface different from the active surface of the anode. The cathode surface is made of a material which catalyses the decomposition of hypochlorite ions.

19 Claims, 5 Drawing Figures

ELECTROLYTIC DIAPHRAGM CELL

BACKGROUND OF THE INVENTION

The present invention is directed to improving diaphragm cells for the electrolysis of aqueous solutions of alkali metal chlorides, for example a sodium chloride brine.

A disadvantage of electrolytic diaphragm cells resides in the difficulty of avoiding the presence of alkali metal chlorate in the alkaline liquor drawn off from the cathode compartments. The presence of alkali metal chlorate in the liquor in fact renders the latter unsuitable for various applications, particularly for the rayon industry, and consequently it necessitates a costly purification of the liquor.

The major part of the alkali metal chlorate present in the alkaline liquor arises from decomposition of hypochlorite ions formed in the anode compartment of the cell, by reaction of the chlorine dissolved in the anolyte with hydroxyl ions coming from the cathode compartment. Besides its unfavourable influence on the presence of chlorate in the alkaline liquor produced in the cell, the formation of hypochlorite ions in the anode compartment gives the disadvantage of also reducing the current efficiency of electrolysis.

In order to reduce the content of chlorate in the alkaline liquor, it has already been proposed, in U.S. Pat. No. 2,823,177 of S. G. Osborne, published Feb. 11, 1958, to incorporate cobalt or nickel in the finely divided state in the diaphragm. In Belgian Pat. No. 773918 of Oct. 14, 1971 in the name of the present applicant it has also been proposed, with the same aim, to incorporate in the diaphragm iron or copper and/or their oxides in the finely divided state.

SUMMARY OF THE INVENTION

The applicant has now found a diaphragm cell for the electrolysis of an aqueous solution of alkali metal chloride which ensures the production of an alkaline liquor having an exceptionally low content of alkali metal chlorate and which furthermore allows, all other things being equal, the obtainment of appreciably improved current efficiencies compared to those obtained with known cells.

The present invention relates therefore to a diaphragm cell for the electrolysis of an aqueous solution of alkali metal chloride comprising a chamber divided by a diaphragm into an anode compartment containing at least one anode and a cathode compartment containing at least one cathode and also comprising, in the anode compartment, a catalytic surface made of material which catalyses the decomposition of hypochlorite ion.

In the cell according to the invention, the effect of the catalytic surface is to decompose hypochlorous acid and alkali metal hypochlorite in the anode compartment itself, with liberation of oxygen, in the proportion in which these unwanted products are formed.

In a preferred embodiment of the cell according to the invention, the material which constitutes the catalytic surface comprises a metal or a metal compound which is resistant to the conditions ruling in the anolyte, and at which the oxygen over potential is not more than 1.5V in a molar solution of potassium hydroxide at a current density of 10 $kA/m^2$. It is advantageously selected from the group consisting of iridium, osmium, palladium, rhodium, and ruthenium, their alloys and their compounds, and is preferably selected from among their oxides.

All other things being equal, the greater the area of the catalytic surface, the more effective is the action of this surface on the reduction of the content of alkali metal chlorate in the alkaline liquor. In general, it is advantageous for the catalytic surface to have an area at least equal to about 5% of the effective anode surface of the cell and preferably greater than about 10% of the effective anode surface. The best results are obtained when the catalytic surface has an area at least equal to 20% of the effective anode surface. For economic reasons, it is not desirable for the catalytic surface to have too great a surface area, for example greater than 300% of the effective anode surface.

By effective anode surface of the cell is meant the useful part of the anode, which effectively participates in the discharge of chloride ions under the normal conditions of operation of the cell.

In the case of a cell of the type described in Belgian Pat. No. 780912 dated Mar. 20, 1972, in the name of the present applicant, which is eqipped with an alternating sequence of anode plates and flat parallel cathodes, placed opposite each other, the effective anode surface corresponds, in general, to the total surface area of the anode plates.

On the other hand, in the case of a cell equipped with special anodes of the type described in Sourth African Patent No. 71,03637 of June 4, 1971, in the name of Richard J. Bright, comprising a vertical block of graphite carrying vertical ribs facing the cathodes, the effective anode surface corresponds to the edges of the ribs adjacent to the cathodes. Experience has in fact shown that the massive block of graphite takes part to a negligible extent, less than 2%, even nil, in the discharge of the chloride ions.

In the case of the known metal anodes, formed of a titanium support carrying a coating of a material which catalyses the discharge of chloride ions, for example platinum, it is generally the practice, for economic reasons to limit the anode coating essentially to the zone of the support which is closest to the cathode, the superficial area of the coating being fixed so as to ensure normal and economic functioning of the cell. In this particular case, the effective anode surface of the cell is in general practically restricted to this coated zone of the anode support. This is for example the case with the anode described in Belgian Pat. No. 791675 of Nov. 21, 1972, in the name of the present applicant, the said anode being formed of two vertical titanium plates, which are disposed opposite each other so as to form a box, and which carry an active coating catalysing the discharge of chloride ions only on their base external to the box.

In the cell according to the invention, the catalytic surface may for example take the form of filaments, plates, foraminous or corrugated sheets, so as to be immersed in the anolyte during electrolysis.

In the cell according to the invention, the catalytic surface may be unpolarised or, alternatively, it may be connected to the positive pole of a direct current source.

BRIEF DESCRIPTION OF THE DRAWINGS

Particular features and details of the invention will become evident from the following description of the accompanying drawings, which represent, by way of example only, some particular embodiments of the cell according to the invention.

DESCRIPTION OF THE PREFERRED EMBODIMENTS

Figure 1:
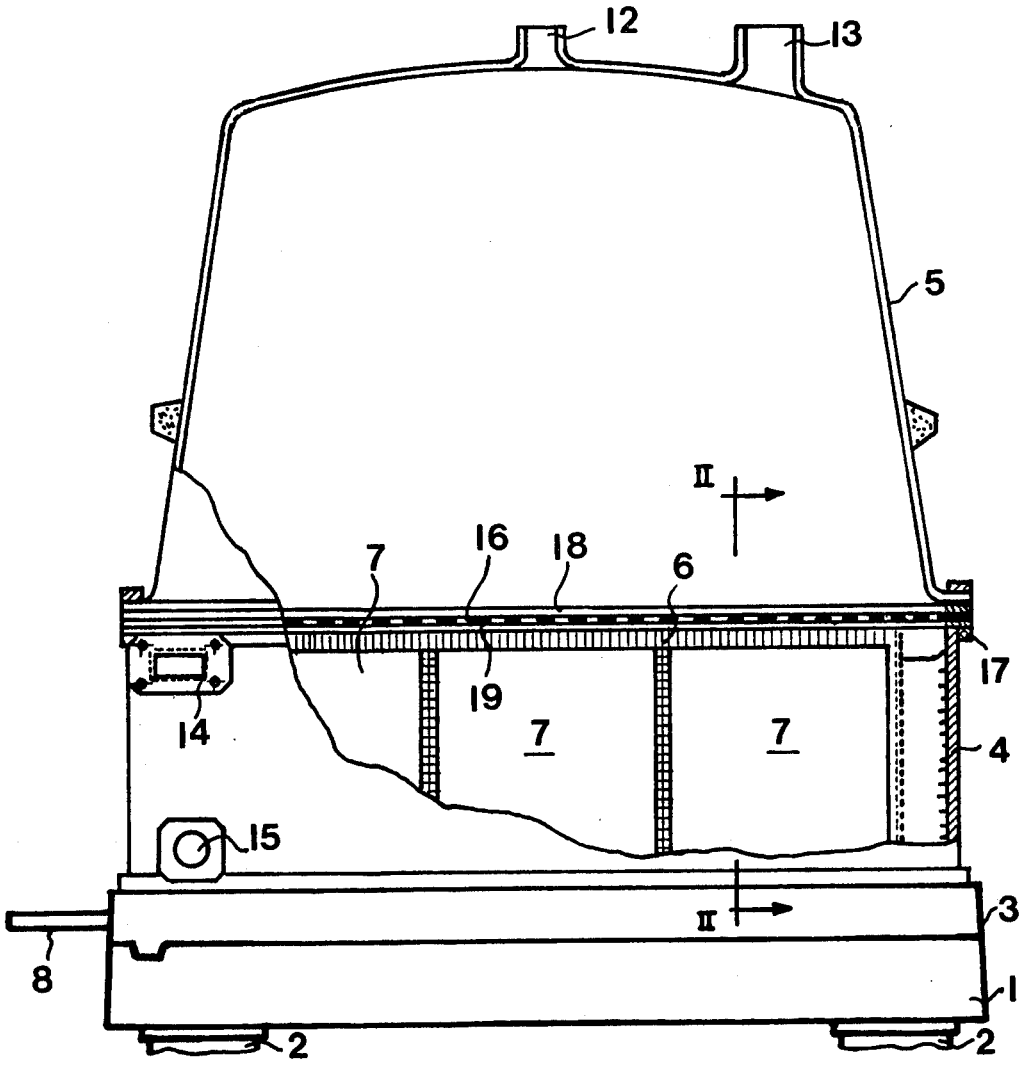
FIG. 1 is a view in longitudinal elevation, partially cut away, of a first embodiment of the cell according to the invention.

In these Figures, the same reference numerals denote identical elements.

Figure 2:
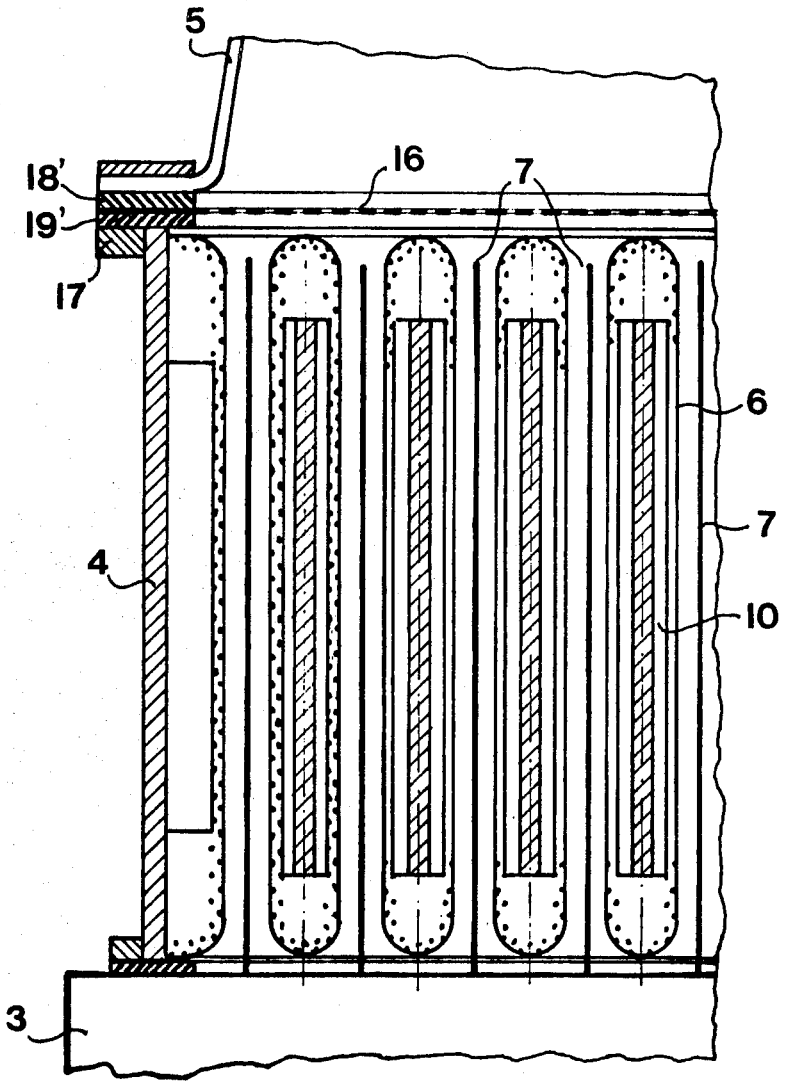
FIG. 2 is, on a larger scale, a partial section in the plane II—II of FIG. 1.

There is depicted in FIGS. 1 and 2 a diaphragm cell with vertical electrodes of the type described in Belgium Patent No. 780912 of Mar. 20, 1972, in the name of the present applicant. The cell comprises, on a foundation 1 supported by insulators 2, a pedestal 3 of concrete forming the floor of the cell, and supporting, at its periphery, a rectangular casing 4 of steel, which is closed by a cover 5. Within the casing 4, cathodes 6 alternate with rows of substantially vertical and parallel anode plates 7, which are fixed to a current lead-in 8 buried in the concrete pedestal 3.

The anodes 7 are for example constituted by graphite plates or, preferably, by plates of titanium carrying on their two faces a known coating which is resistant to the conditions ruling in the cell and which catalyses the discharge of chloride ions. By way of example, the anode coating may comprise a metal of the platinum group or a compound, for example an oxide, of a metal of this group.

The effective anode surface of the cell is substantially equal to the total area of the two faces of the group of anode plates 7.

The cathodes 6 are formed of a steel trellis, fixed to the wall of the casing 4 and shaped so as to form cathode compartments or pockets 10 extending between the anodes 7. The cathode lattice 7 is entirely covered by a diaphragm (not shown), which thus separates the cathode compartments 10 from the anode compartment containing the anodes 7.

The anode compartment is in communication, by way of the cover 5, with a conduit 12 for admission of a sodium chloride brine and with a conduit 13 for removal of chlorine produced at the anodes 7. The cathode compartments are in communication, by way of the casing 4, with a conduit 14 for removal of hydrogen liberated at the cathode during electrolysis and with a conduit 15 for removal of an alkaline liquor.

In accordance with the invention, the anode chamber of the cell contains a horizontal foraminous plate 16 made of a material which catalyses decomposition of hypochlorite ions. The foraminous plate 16 is held, at its periphery, between the cover 5 and a peripheral flange 17 of the casing 4, with interposition of sealing joints 18′ and 19′, so that the plate is immersed in the anolyte during electrolysis.

The foraminous plate 16 may be constituted by a perforated or expanded sheet of a film-forming metal, coated with a material which catalyses the decomposition of hypochlorite ions in the anolyte.

The film-forming metal of the plate 16 may advantageously be selected from the group consisting of titanium, tantalum, niobium, tungsten, zirconium and their alloys.

The material which catalyses the decomposition of hypochlorite ions may advantageously be selected from the metals of the group consisting of iridium, osmium, palladium, rhodium, and ruthenium, their alloys or their oxides, for which the oxygen over potential in an aqueous solution of potassium hydroxide is at most equal to 1.5v under a current density of $10kA/m^2$. The catalytic material is preferably constituted by a mixture of an oxide of a metal of the group consisting of iridium, osmium, palladium, rhodium and ruthenium and an oxide of a film-forming metal of the group consisting of titanium, tantalum, niobium, tungsten and zirconium.

In an advantageous modification of the embodiment of FIGS. 1 and 2, the catalytic plate 16 is constituted by a lattice made of a synthetic polymer resistant to corrosion by chlorine and the anolyte, and covered with the catalytic material. The polymer constituting the lattice maybe a fluorinated polymer, for example polytetrafluoroethylene, polyvinylidenefluoride or polychlorotrifluoroethylene, such as that known by the name KEL-F (Kellog Company). The rigidity of the lattice may optionally be increased by means of cross braces.

Figure 3:
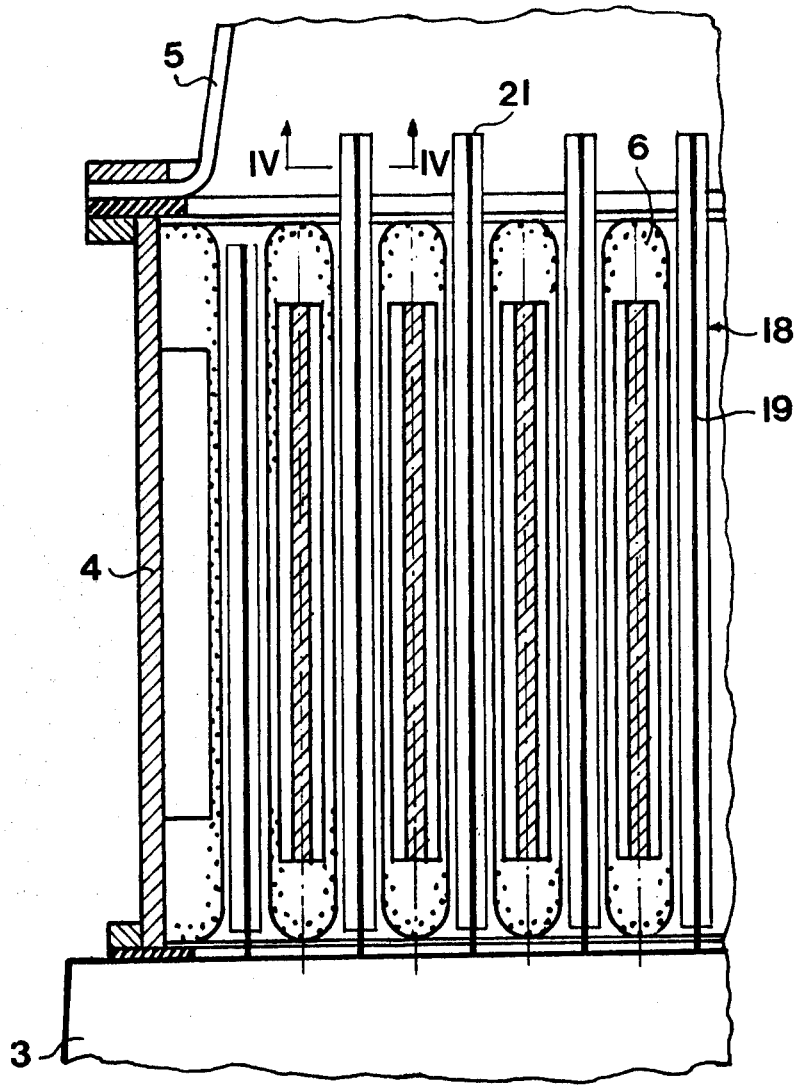
FIG. 3 is a view, analagous to FIG. 2 of a second embodiment of the cell according to the invention.
Figure 4:
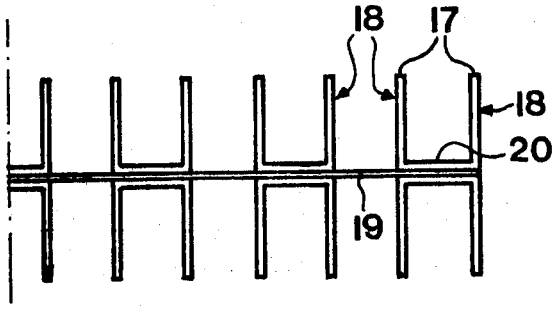
FIG. 4 shows, on a larger scale, a detail of FIG. 3, seen in section in the plane IV—IV of FIG. 3.

In FIGS. 3 and 4 is shown a preferred embodiment of the cell according to the invention.

In the cell of FIGS. 3 and 4, each anode comprises a series of vertical fins 18 fixed perpendicularly to a vertical supporting plate 19. The latter is connected to a current lead-in buried in a concrete pedestal 3, as in the case of the cell of FIGS. 1 and 2. The fins 18 are formed for example by the blades of vertical U-shaped profiles welded to the supporting plate 19 along the web 20.

The effective anode surface of the cell of FIGS. 3 and 4 corresponds to the area of the free ends 17 of the fins, which are immediately adjacent to the cathodes 6. These free ends 17 of the fins thus constitute the anodes proper, where the discharge of chloride ions effectively takes place. The remaining part of the fins 18, the web 20 of the U-profile and the supporting plate 19 constitute the catalytic surface, capable of decomposing hypochlorite ions in the anolyte.

The U-profile and the supporting plate 19 may for example be made of titanium; the free ends 17 of the blades 18 are covered with a material catalysing the discharge of chloride ions, for example platinum, while the remaining part of the blades 18, the web 20 of the U-profiles and the supporting plate 19 are covered with a material catalysing the decomposition of hypochlorite ions in the anolyte, for example ruthenium oxide.

In a modification, there may be used, for the assembly of the U-profiles and the supporting plate 19, a coating which is suitable both for catalysing the discharge of chloride ions and for catalysing the decomposition of hypochlorite ions in the anolyte, for example a mixture of ruthenium oxide and titanium dioxide.

In this particular modification of the invention, the free ends 17 of the fins constitute the effective anode surface of the cell, that is to say the useful part of the fins, which participates effectively in the process of discharging chloride ions, during normal operation of the cell. The remaining part of the fins and the supporting plate 19 participate to a negligible extent, less than 2%, even not at all, in the process of discharging chloride ions.

According to another modification of the cell of FIGS. 3 and 4, the supporting plate 19 and the U-profiles are extended upwards, beyond the cathodes 6, underneath the cover 5 of the cell. The portion 21 of the supporting plate 19 and the U-profiles, which thus extends above the anodes and the cathodes is coated with a material which catalyses the decomposition of hypochlorite ions.

Figure 5:
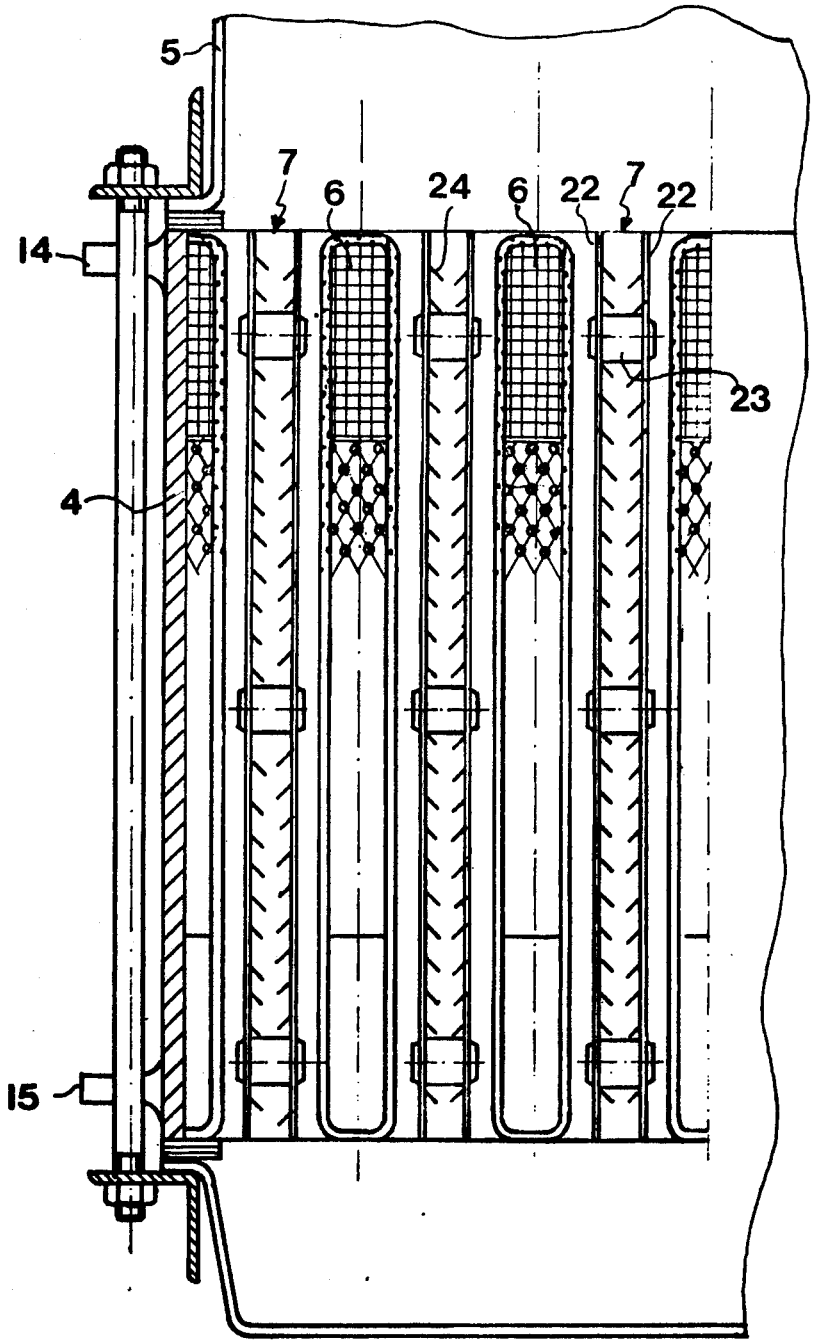
FIG. 5 is a view analagous to FIGS. 2 and 3 of a third embodiment of the cell according to the invention.

In the embodiment showed in FIG. 5, the cell according to the invention is equipped with anodes 7, each of which is formed by a pair of substantially vertical titanium plates 22, placed face to face so as to form a hollow box, open at its upper and lower ends, within which the anolyte circulates downwardly during electrolysis. Cross braces 23 maintain the separation between the two plates 22 of the anode boxes 7. The titanium plates 22 carry on their surface external to the anode boxes 7 a coating catalysing the discharge of chloride ions during electrolysis.

In the cell of FIG. 5, the effective anode surface is equal to the total area of the external coated surfaces of the plates 22 of the group of anode boxes 7.

According to the invention, the plates 22 are covered, on their surface facing towards the interior of the anode boxes 7, with a coating catalysing the decomposition of hypochlorite ions in the anolyte.

In an advantageous modification of the embodiment of FIG. 5, inclined fins 24 made of titanium, carrying a coating catalysing the decomposition of hypochlorite ions, are fixed, for example welded, to the plates 22, inside the anode boxes 7. All other things being equal, these fins increase the surface catalysing the decomposition of hypochlorite ions; additionally they cause turbulence in the flow of the anolyte within the anode boxes 7, improving the rate of decomposition of the hypochlorite ions in the anolyte.

In order to demonstrate the advantage of the invention comparative tests were carried out in a laboratory electrolysis cell equipped with vertical rectangular anode and cathode of area 120 $cm^2$, separated by an asbestos diaphragm. The anode is formed of a titanium plate carrying a coating made of a mixture of 50% ruthenium oxide and 50% titanium dioxide by weight. The cathode is formed of a steel lattice and supports the diaphragm.

The effective anode surface of this laboratory cell is equal to the area of the anode, namely 120 $cm^2$.

In each of the comparative tests, a brine containing 260g of sodium chloride per kg was electrolysed at a current density of about 2 $kA/m^2$ of anode surface. The temperature of the brine in the cell was maintained at about 85° C during electrolysis. An alkaline liquor containing about 11% by weight of caustic soda was drawn from the cell. In each test the current efficiency of the electrolytic operation in terms of chlorine production and the content of sodium chlorate in the alkaline liquor were measured.

FIRST SERIES OF TESTS (COMPARATIVE)

Two successive tests of electrolysis were carried out in the laboratory cell prior to the invention, in which the anode compartment was not equipped, in addition to the anode, with a surface catalysing the decomposition of hypochlorite ions in the anolyte. The results obtained in each test are recorded in Table I.

TABLE I

| Test No. | Current efficiency (%) | Content of sodium chlorate in the alkaline liquor (ppm) |
|---|---|---|
| 1 | 94.1 | 320 |

TABLE I-continued

| Test No. | Current efficiency (%) | Content of sodium chlorate in the alkaline liquor (ppm) |
|---|---|---|
| 2 | 94.8 | 310 |

SECOND SERIES OF TESTS (IN ACCORDANCE WITH THE INVENTION)

In accordance with the invention, a lattice of titanium carrying a coating catalysing the decomposition of hypochlorite ions in the anolyte was placed in the anode compartment of the laboratory cell.

Test No. 3

There was employed a catalytic lattice of surface area 24 $cm^2$ (corresponding to 20% of the effective anode surface of the cell), the coating of which consisted of a mixture of 50% by weight of ruthenium oxide and 50% by weight of titanium dioxide. During electrolysis there were recorded a current efficiency of 96.7% in respect of chlorine production and a sodium chlorate content in the alkaline liquor of 46 ppm.

Test No 4

There was employed a catalytic lattice of the same composition as that of Test No 3, but having a surface area equal to 120 $cm^2$, which corresponds to 100% of the effective anode surface of the cell. During electrolysis there were recorded a current efficiency of 96.3% and a content of 30 ppm of a sodium chlorate in the alkaline liquor.

Test No 5

There was employed a catalytic lattice of titanium having the same composition of coating as in tests 3 and 4, but of surface area equal to 240 $cm^2$ (which corresponds to 200% of the effective anode surface of the cell). There were recorded a current efficiency of 94.4% and a content of chlorate in the alkaline liquor equal to 27 ppm.

Test No 6

There was employed a catalytic lattice of titanium of 120 $cm^2$ (which corresponds to 100% of the effective anode surface of the cell), carrying a coating of ruthenium oxide. The current efficiency of electrolysis in respect of chlorine rose to 95.5% and the alkaline liquor showed a content of sodium chlorate equal to 32 ppm.

In Table II are recorded the results of the second series of tests.

TABLE II

| Test No | Catalytic Material | Catalytic surface ($cm^2$) | Current efficiency (%) | Chlorate content of the alkaline liquor (ppm) |
|---|---|---|---|---|
| 3 | 50% $RuO_2$/50%$TiO_2$ | 24 | 96.7 | 46 |
| 4 | " | 120 | 96.3 | 30 |
| 5 | " | 240 | 94.4 | 27 |
| 6 | $RuO_2$ | 120 | 95.5 | 32 |

A comparison of Tables I and II demonstrates the improvement provided by the invention in regard to the current efficiency of electrolysis and the content of alkali metal chlorate in the alkaline liquor drawn from the cathode compartment.

The invention is obviously not limited exclusively to the preceding examples, numerous modifications being possible without departing from the compass of the following claims.

We claim:

1. Diaphragm cell for the electrolysis of an aqueous solution of alkali metal chloride, comprising a chamber divided by a diaphragm into an anode compartment containing at least one anode having a surface effective for discharging chloride ions during operation of the cell and a cathode compartment containing at least one cathode, characterized in that the cell also comprises, in the anode compartment, a catalytic surface different from said effective anode surface made of a material which catalyses the decomposition of hypochlorite ions.

2. Cell according to claim 1, characterised in that the material of the catalytic surface is a metal or a metal compound at which the overpotential of oxygen is at most equal to 1.5V in a molar solution of alkali metal hydroxide under a current density of 10 $kA/m^2$.

3. Cell according to claim 1, characterised in that the material of the catalytic surface is selected from the group consisting of iridium, osmium, palladium, rhodium and ruthenium, their alloys and their compounds.

4. Cell according to claim 3, characterised in that the catalytic material comprises a mixture of an oxide of a metal of the group consisting of iridium, osmium, palladium, rhodium and ruthenium and an oxide of a film-forming metal of the group consisting of titanium tantalum, niobium, tungsten and zirconium.

5. Cell according to claim 4, characterised in that the catalytic material consists of a mixture of 50% by weight of ruthenium oxide and 50% by weight of titanium dioxide.

6. Cell according to claim 1, characterised in that the area of the catalytic surface is at least equal to 5% of the effective anode surface of the cell.

7. Cell according to claim 6, characterised in that the area of the catalytic surface is at least equal to 10% of the anode surface of the cell.

8. Cell according to claim 7, characterised in that the area of the catalytic surface is substantially between 20 and 300% of the anode surface of the cell.

9. Cell according to claim 1, characterised in that the catalytic surface comprises a substrate made of a film-forming metal of the group consisting of titanium, tantalum, niobium, tungsten, zirconium and their alloys, on which the catalytic material is applied.

10. Cell according to claim 1, characterised in that the catalytic surface comprises a substrate made of a synthetic polymer resistant to corrosion in the anolyte, on which the catalytic material is applied.

11. Cell according to claim 10, characterised in that the synthetic polymer is a fluorinated polymer.

12. Cell according to claim 1, characterised in that the catalytic surface comprises fins disposed transversely with respect to the cathode.

13. Cell according to claim 12, characterised in that the fins of the catalytic surface are extensions of fins constituting at least part of the anode.

14. Cell according to claim 1, characterised in that, in the case where the anode comprises two substantially vertical plates placed face to face so as to form a box which is open at least in the region of its upper and lower extremities, the catalytic surface is set between the two plates of the anode.

15. Cell according to claim 1, characterized in that, in the case of a cell comprising a series of substantially vertical and parallel anodes, alternating with cathode pockets that have foraminous walls, covered with a diaphragm, the catalytic surface is located above said anode and cathode pockets.

16. Cell according to claim 1, in which said surface comprises wires.

17. Cell according to claim 1, in which said surface comprises plates.

18. Cell according to claim 1, in which said surface comprises foraminous sheets.

19. Cell according to claim 1, in which said surface comprises corrugated sheets.

* * * * *